United States Patent [19]

DuNah

[11] 4,101,955

[45] Jul. 18, 1978

[54] ORNAMENTAL ARTICLE WITH ILLUMINATED DISPLAY

[75] Inventor: Richard E. DuNah, Mountain View, Calif.

[73] Assignee: Precision Lamp, Mountain View, Calif.

[21] Appl. No.: 731,122

[22] Filed: Oct. 12, 1976

[51] Int. Cl.[2] ..... F21L 15/08

[52] U.S. Cl. ..... 362/104; 63/18

[58] Field of Search ..... 240/6.4 W, 6.4 R, 10.6 R, 240/10 R, 2 R; 63/18–20

[56] References Cited

U.S. PATENT DOCUMENTS

| | | | |
|---|---|---|---|
| 2,265,670 | 12/1941 | Platt | 63/20 X |
| 2,854,563 | 9/1958 | Catching | 240/6.4 W |
| 3,384,740 | 5/1968 | Wood | 240/6.4 W |
| 3,392,275 | 7/1968 | Henrich | 240/10.6 R X |
| 3,805,047 | 4/1974 | Dockstader | 240/6.4 W |

*Primary Examiner*—Richard L. Moses

[57] ABSTRACT

An illuminated display is presented on an ornamental article through a lens carried by the article. The article has a case in which the lens is mounted which contains a miniature incandescent lamp adjacent to the lens providing the light for illuminating the display. The case also defines a battery compartment configured to hold a miniature electric battery which provides the energy for illuminating the lamp. The case also has mounted therein an externally accessible switch for selectively energizing and de-energizing the lamp.

11 Claims, 6 Drawing Figures

ORNAMENTAL ARTICLE WITH ILLUMINATED DISPLAY

BACKGROUND OF THE INVENTION

This invention relates to an illuminated display and more particularly to such a display for wearing on the person.

Strings of lighted elements electrically energized, are known for dispersal through a wearer's hair or around articles of wearing apparel where such lighted elements have the purpose of enhancing the wearer's appearance. Such arrays of lighted elements require conducting leads to extend between the lighted elements and also require the wearer to carry an electrical power supply such as a dry cell storage battery somewhere on the wearer's person. The conducting leads together with the bulk of the power supply provide serious inconveniences to the wearer. Other devices are known where the power supply is carried remotely on the person and the conducting leads are connected to a lighted ornamental article through a cord which may serve as a band for hanging the article around the wearer's neck as well as a path for delivering the electrical energy to the lighted elements in the ornamental article. The inconvenience of the bulk of the power supply which must yet be carried and the conductive leads thereto is not overcome.

A relatively small lighted ornamental article is desirable which contains lens, lamp and electrical energy source, so that the above referenced remotely located power supply bulk and conducting lead inconvenience between lighted elements and power supply are avoided.

SUMMARY AND OBJECTS OF THE INVENTION

An ornamental article case has a front section and a rear section which join together to define a battery chamber and a lens chamber therein. The battery chamber is configured to receive a miniature electrical battery. A lens opening is formed in the front case section in communication with the lens chamber and a switch opening is formed in the rear case section in communication with the battery chamber. A lens is mounted in the lens opening and a light source is mounted in the lens chamber cooperating with the lens to transmit light therethrough when energized. A switch member is mounted in the switch opening and a pair of spring terminals are mounted in the case extending into the battery chamber to contact opposed electrical terminals on the miniature battery when placed therein. The switch member carries structure for urging one of the spring terminals away from contact with one of the battery terminals. Conductive leads are connected between the battery and the light source. Consequently, the light source is deenergized when the switch member is positioned so that the structure thereon urges the spring terminal away from the battery terminal. Conversely when the structure on the switch member is not in contact with the spring terminal an electrical circuit is completed through the light source causing light to be transmitted through the lens, thereby providing an illuminated display. The ornamentaL article is envisioned as being suspended from a chain or string and carried about a portion of the wearer's body, or as being pinned to an article of wearing apparel to thereby provide a pleasing display.

In general, it is an object of the present invention to provide an ornamental article for wearing on the person which has contained light and light energizing sources.

Another object of the present invention is to provide a lighted ornamental article which is controlled to the on and off conditions by the wearer.

Another object of the present invention is to provide a lighted ornamental article wherein assembly of a minimum number of structural parts is accomplished in a minimum amount of time by minimally skilled assemblers.

Additional objects and features of the invention will appear from the following description in which the preferred embodiment has been set forth in detail in conjunction with the accompanying drawings.

BRIEF DESCRIPTON OF DRAWINGS

DESCRIPTION OF THE PREFERRED EMBODIMENT

Figure 1:
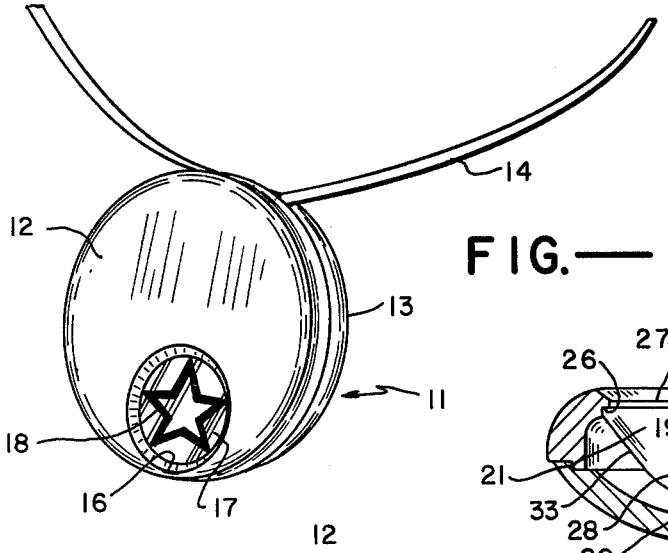
FIG. 1 is an isometric view of the illuminated ornamental article in pendant form.

The ornamental article disclosed herein is seen in perspective in FIG. 1. An outer case 11 has a front case section 12 and a rear case section 13 which are joined together as shown. The ornamental article may be worn by pinning it to an article of apparel on a person by means of a pin (not shown) attached to rear case section 13, or by suspending it on a chain or string 14 as shown in FIG. 1 which surrounds the neck of the wearer, for example. Front case section 12 is shown having a lens aperture 16 therein which accepts a lens 17. Lens 17 may have a decal, such as the star 18 shown thereon in FIG. 1. A set of decals having different designs for placement overlying lens 17 may be provided. In this fashion a selected decal design may be placed on lens 17 in place of star 18. The decals may be snapped into place or held by a yieldable adhesive.

Figure 2:
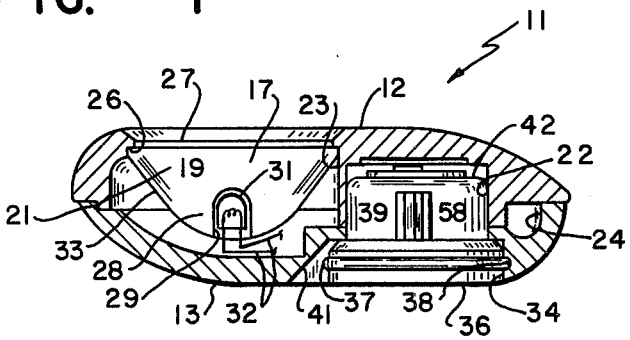
FIG. 2 is a sectional side view of the Illuminated ornamental article of FIG. 1.

The manner in which outer case 11 is formed by joining front case section 12 and rear case section 13 is shown in FIG. 2. Rear case section 13 has an inner locating diameter 19 near the lip thereof and front case section 12 has an outer locating diameter 21 near the lip thereof. When inner and outer locating diameters 19 and 21 respectively are placed adjacent to one another, outer case 11 forms a battery chamber 22 and a lens chamber 23 therein. A passage 24 is also formed through outer case 11 between front and rear case sections 12 and 13 respectively. Passage 24 serves to surround a chain or the supporting string 14 for suspending the ornamental article in pendant form.

Lens aperture 16 is seen to be in communication with lens chamber 23 and lens 17 is shown in FIG. 2 to be mounted in lens chamber 23 on a ledge 26 surrounding lens aperture 16. Lens 17 in this embodiment has a planar front face 27 and a convex rear face 28. It should be understood that front face 27 could be convex or concave in keeping with desired light emission characteristics from the display. Lens 17 has a bore 29 formed through convex rear face 28 which is configured to accept a miniature incandescent lamp 31. A pair of conducting leads 32 extend from miniature lamp 31 which are connected to opposite ends of the incandescent light emitting filament therein. It should be understood that other light sources, such as light emitting diodes, could be substituted for miniature incandescent lamp 31. Convex rear face 28 on lens 17 may have a reflective coating 33 thereon so that light entering lens 17 from miniature incandescent lamp 31 will substantially all be reflected through planar front face 27 on lens 17.

Rear case section 13 has a switch aperture 34 therein which communicates with battery chamber 22 and in which is mounted a switch member 36. In this embodiment switch member 36 takes the form of a disc having a bead 37 around the circumference thereof which is formed to fit in a matching groove 38 extending around the periphery of switch aperture 34. Switch member 36 also has a switch post 39 attached thereto extending into battery chamber 22. It may be seen that switch member 36 is disposed in switch aperture 34 for rotary motion therein as bead 37 passes in sliding fashion through matching groove 38. Switch member 36 is removable from switch aperture 34 by inserting a lever (not shown) between a ramp 41 and the periphery of switch member 36 and exerting a prying motion on the lever to snap bead 37 out of matching groove 38. In this fashion battery chamber 22 is made accessible from the exterior of outer case 11. A well known miniature battery 42 such as the nickel cadmium type for example, is shown positioned in battery chamber 22.

Figure 3:
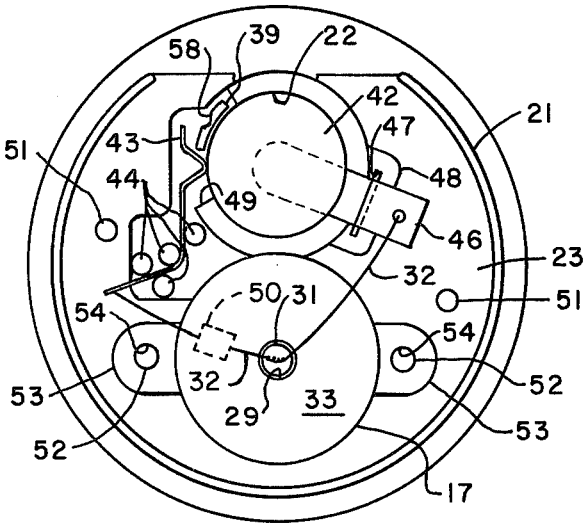
FIG. 3 is a plan view of the ornamental article with the rear case section removed.

Turning now to FIG. 3, rear case section 13 is removed showing lens 17 in lens chamber 23 and battery 42 in battery chamber 22. A first spring terminal 43, shaped as shown and mounted between a plurality of posts 44 extends into battery chamber 22. First spring terminal 43 is shown contacting the periphery of battery 42, which is one of the electrical terminals thereon. A second spring terminal 46 is shown extending into battery chamber 22 and fixed in position by having a portion thereof entering a slot 47 in a terminal post 48 formed on the interior of front case section 12. Second spring terminal 46 is shown contacting one end of battery 42 which is the opposing electrical terminal thereon. Electrical leads 32 are shown, one each being in electrical contact with one of the first and second spring terminals 43 and 46. An opening 49 is shown in battery chamber 22 through which first spring terminal extends to contact the periphery of battery 42.

Figure 6:
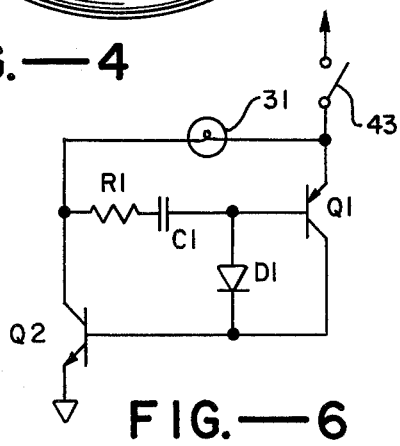
FIG. 6 is an electrical schematic of one embodiment of the present invention.

It is envisioned that case 11 may contain a flasher circuit 50 which could be positioned electrically as shown in dashed lines in FIG. 3. The circuit 50 may be any of several known configurations, one of which is ssen in FIG. 6. When contact 43 is in the closed position, transistors Q1 and Q2 operate at the resonant mode for the series combination of R1 and C1 to provide an oscillatory current through lamp 31. A flashing display is thus provided from lens 17.

A pair of case locating posts 51 are shown formed on the inner surface of front case section 12 and a pair of lens locating posts 52 are shown also formed thereon. Lens 17 has side tabs 53 extending from the edge thereof. Tabs 53 have holes 54 fromed therethrough on substantially the same spacing as lens locating posts 52. Lens 17 is fixed in position in lens aperture 16 by pressing tabs 53 over lens locating posts 52 allowing them to pass through holes 54 until planar front face 27 seats on ledge 26. Lens 17 may thereafter be retained on lens locating posts 52 by frictional engagement therewith or by placing some epoxy or other suitable cement around lens locating posts 52 and the surface of tabs 53. Miniature incandescent lamp 31 may also be held in position in bore 29 by the stiffness of conductive leads 32 or by placing some epoxy or other suitable cement about the miniature incandescent lamp 31 after it is inserted into bore 29.

Figure 4:
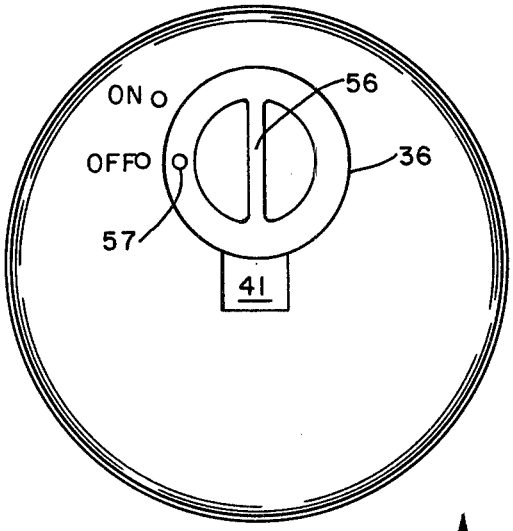
FIG. 4 is a rear plan view of the illuminated ornamental article.

With reference to FIG. 4, switch member 36 is shown having a raised center portion 56 thereon for grasping by the fingertips to impart rotational movement thereto. An indicator dot 57 is aligned with switch post 39. With switch post 39 in the position shown in FIG. 2 and as indicated in FIG. 4, first spring terminal 43 will be urged away from the periphery of battery 42 and will rest in a notch 58 in switch post 39. Thus, the circuit from battery source 42 through the incandescent element in miniature incandescent lamp 31 is broken. When raised portion 56 is manually engaged and rotated to a point where indicator dot 57 is opposite the "on" position as indicated in FIG. 4, switch post 39 assumes the position shown in FIG. 3 and first spring terminal 43 passes through opening 49 in battery chamber 22 as urged by the spring force therein, to contact one electrical terminal at the periphery of battery 42. It may thus be seen that it is only necessary for switch member 36 to pass through the angle between the on and off positions seen in FIG. 4 to effect manual control of light emission from miniature incandescent lamp 31.

Figure 5:
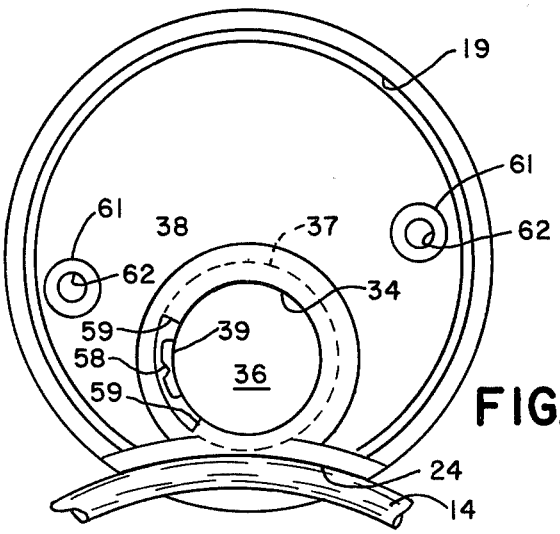
FIG. 5 is a plan view of the illuminated ornamental article with the front case section removed.

FIG. 5 shows the interior of rear case section 13 together with stops 59 located to limit the rotational movement of switch member 36 to that required for switch post 39 to rotate between the on and off positions shown in FIGS. 3 and 2 respectively. Thus, switch post 39 is rotated between the off position, where it urges spring terminal 43 away from contact with the terminal on battery 42, and the on position, where it assumes an out-of-the-way position allowing first spring terminal 43 to come into contact with one terminal of battery 42. The switch 36 is held in the off position by a V portion on first spring terminal 43 which enters notch 58 on switch post 39. Switch 36 is held in the on position by means of the spring force urging first spring terminal 43 into contact with one terminal of battery 42, which force is sufficiently large to prevent switch post 39 from slipping between first spring terminal 43 and the battery terminal. FIG. 5 also shows a pair of case locating lands 61 on the inner surface of rear case section 13 having locating bores 62 therein for receiving case locating posts 51 on front case section 12. In this fashion front and rear case sections 12 and 13 respectively are located in angular orientation.

A colored or metallic coating may be applied to the outer surface of outer case 11 to further enhance the pleasing appearance of the lighted ornamental article. Decals or sets of decals of different decorative design, or decals carrying written inscriptions are envisioned as being available for application to front face 27 of lens 17 in place of the star 18 which is shown. A lighted ornamental article has been disclosed which will emit either steady or flashing light and which is appropriate for pinning on a wearer's apparel or for wearing as a pendant around the neck or wrist, etc. The necessity for carrying remotely located power suuplies or external conductive members extending between light producing elements and the remotely located power supplies is removed. Moreover, an illuminated ornamental article is disclosed which may be manually controlled to emit light or to simply serve as a non-lighted piece of jewelry at the wearer's option.

What is claimed is:

1. A lighted ornamental article utilizing a miniature battery as a power source, comprising a case having a front section and a back section cooperating to define a lens chamber, an aperture in said case front section, a lens fixed in said chamber with the front side of said lens in said aperture and a rear side extending into said chamber, said lens having a bore in said rear side, a miniature incandescent lamp in said bore, said case additionally having an internal chamber therein configured to retain the miniature battery, first and second spring terminals, means for retaining said first and second spring terminals in positions extending into said internal chamber, so that electrically opposed terminals on the battery are contacted by said first and second spring terminals, electrical conductors extending between each of said first and second spring terminals and said miniature incandescent lamp, means mounted in said case back section for moving said first spring terminal between positions in contact and out of contact with one of the opposing battery terminals, whereby manipulation of said last named means provides elective emission of light through said lens.

2. A lighted ornamental article as in claim 1 together with a decal mounted on said lens front side whereby said decal is illuminated when said first spring terminal is in contact with one opposing battery terminal.

3. An illuminated ornamental article as in claim 1 wherein said means mounted in said case back section comprises a disc disposed to rotate through a predetermined angle in said case back section, a post on said disc extending into said internal chamber providing the contact with said first spring terminal, so that the completion and interruption of said electrical circuit is obtained at opposing limits of said predetermined angle.

4. An illuminated ornamental article as in claim 3 together with a flasher circuit coupled to said electric lamp so that when said electrical circuit is completed a flashing light is intermittently emitted from said lens.

5. An illuminated ornamental article as in claim 3 together with means on said rear case section for releasably engaging said disc, whereby removal of said disc provides access to said battery chamber through said switch aperture.

6. An illuminated ornamental article as in claim 1 together with a coating on said outer case providing a predetermined color surrounding said lens and enhancing said pleasing display.

7. An illuminated ornamental article, comprising an outer case having a front and rear surface, said outer case section containing a lens chamber therein, an aperture in said front surface in communication with said lens chamber, a lens having a front surface and a convex rear surface disposed in said chamber with the front surface in said aperture, a light source receiving well extending into said lens from the convex rear surface, a miniature light source in said well operating to emit light to be transmitted through said lens to the front surface when said miniature light source is energized to thereby illuminate the front surface.

8. An illuminated ornamental article as in claim 7 together with a reflective coating on said lens surface in said lens chamber, whereby substantially all light emitted by said miniature light source is transmitted through said lens to said front surface.

9. An illuminated ornamental article as in claim 7, in which said outer case further containing a battery chamber a miniature storage battery, said rear surface having a rear aperture therein in communication with said battery chamber, and removable means in said rear aperture affording external access to said battery chamber.

10. An illuminated ornamental article as in claim 7 together with at least one decal mounted on the front surface of said lens.

11. An illuminated ornamental article using a miniature electrical battery comprising a front case section, a rear case section, said front and rear case sections being configured to join together to provide an outer case, said outer case containing a battery chamber and a lens chamber therein, said battery chamber being configured to receive the miniature electrical battery therein, said front case section having a lens aperture therein communicating with said lens chamber, said rear case section having a switch aperture therein communicating with said battery chamber, a lens configured to fit in said lens aperture, said lens comprising a planar front side and a convex rear side, a bore formed in said convex side, a light source mounted in said lens bore, side tabs engaging said front case section adjacent to said lens aperture operating to fix said lens in said chamber, a switch member mounted for movement in said switch aperture, first and second terminals mounted in said outer case extending into said battery chamber so that electrically opposed terminals on a battery contained therein are contacted thereby, means attached to said switch member for selectively placing said first spring terminal into and out of contact with one of the electrically opposed battery terminals, and electrically conductive leads connected between each of said first and second terminals and said light source so that said light source is selectively energized by actuation of said switch member to thereby present a pleasing display.

* * * * *